US008702166B2

(12) United States Patent
Brunner

(10) Patent No.: US 8,702,166 B2
(45) Date of Patent: Apr. 22, 2014

(54) CHAIR SUPPORT APPARATUS

(76) Inventor: Paul Edward Brunner, Idaho Springs, CO (US)

( * ) Notice: Subject to any disclaimer, the term of this patent is extended or adjusted under 35 U.S.C. 154(b) by 83 days.

(21) Appl. No.: 13/429,356

(22) Filed: Mar. 24, 2012

(65) Prior Publication Data

US 2012/0181823 A1 Jul. 19, 2012

Related U.S. Application Data

(63) Continuation-in-part of application No. 12/348,268, filed on Jan. 2, 2009, now abandoned.

(60) Provisional application No. 61/018,518, filed on Jan. 2, 2008.

(51) Int. Cl.
*A47C 7/62* (2006.01)

(52) U.S. Cl.
USPC ..... 297/188.08; 297/16.2; 297/45

(58) Field of Classification Search
USPC ..... 297/16.2, 45, 188.08
See application file for complete search history.

(56) References Cited

U.S. PATENT DOCUMENTS 1,185,568 A * 5/1916 Zeunert ..... 108/115
1,481,521 A * 1/1924 Marsh ..... 297/56
4,369,987 A * 1/1983 Witherell ..... 280/644
4,544,203 A * 10/1985 Younger et al. ..... 297/391
4,577,878 A * 3/1986 Roy et al. ..... 280/250.1
5,058,949 A * 10/1991 Von Hoffman ..... 297/45
5,984,406 A * 11/1999 Lee ..... 297/16.2
6,000,752 A * 12/1999 Shyr ..... 297/188.08
6,053,570 A * 4/2000 Stern et al. ..... 297/188.08
7,100,877 B2 * 9/2006 Bourke et al. ..... 248/166
7,338,131 B2 * 3/2008 Forgatsch ..... 297/423.15
7,384,097 B2 * 6/2008 Park et al. ..... 297/45
7,427,101 B1 * 9/2008 Zernov ..... 297/184.14
7,748,777 B2 * 7/2010 Park et al. ..... 297/45
RE43,847 E * 12/2012 Le Gette et al. ..... 297/16.2
8,453,279 B2 * 6/2013 Hora ..... 5/122
2003/0057741 A1 * 3/2003 Zheng ..... 297/16.2
2003/0080592 A1 * 5/2003 Isom et al. ..... 297/16.2
2004/0140696 A1 * 7/2004 Grace ..... 297/16.2
2006/0163922 A1 * 7/2006 Flannery ..... 297/250.1
2006/0232108 A1 * 10/2006 Hsieh ..... 297/45
2007/0013211 A1 * 1/2007 Crowell ..... 297/16.2
2009/0140556 A1 * 6/2009 Degelman et al. ..... 297/16.2
2009/0250978 A1 * 10/2009 Reynolds ..... 297/16.2
2011/0043007 A1 * 2/2011 Jones ..... 297/188.08
2011/0095576 A1 * 4/2011 Reeb et al. ..... 297/16.2

* cited by examiner

*Primary Examiner* — David E Allred
(74) *Attorney, Agent, or Firm* — Roger A. Jackson

(57) ABSTRACT

A chair support apparatus includes partially affixed first and second flexible panels with a first and second outer periphery portion respectively, also a plurality of channels are formed between the first and second flexible panels bounded by the partial affixment. Also, a plurality of straps are disposed within each one of the channels, wherein each of the straps has a pair of extensions that extend beyond the first and second outer peripheries, each strap has a slip fit engagement within each channel allowing relative movement between the first and second flexible panels and the strap. Operationally, each of the strap extensions is engaged to a beam of a chair for drawing taut a plurality of portions of the first and second flexible panels resulting in a remaining plurality of portions of the first and second flexible panels drooping from the relative movement as between the taut portions to retain accessories.

3 Claims, 13 Drawing Sheets

CHAIR SUPPORT APPARATUS

RELATED PATENT APPLICATIONS

This is a continuation in part (CIP) patent application of U.S. patent application Ser. No. 12/348,268 filed on Jan. 2, 2009 now abandoned by Paul Edward Brunner of Lakewood, Colo., US, that in turn claims benefit of U.S. provisional patent application Ser. No. 61/018,518 filed Jan. 2, 2008 by Paul Brunner.

TECHNICAL FIELD

The present invention relates generally to an apparatus, which is employed to provide support for a user to sit down. More specifically, the present invention relates to the field of portable seating apparatus for controlling the support and stability when the seating apparatus is placed upon a soft surface such as soggy soil, sand, snow, and the like. Furthermore, the support and stability of the seating apparatus is improved by the present invention when any one or more of its plurality of support legs is disposed upon a softer surface portion than the other support legs that can potentially lead to the seating apparatus overturning, wherein this can be especially acerbated when the user individual who is seated in the chair may lean backward, forward, or to either side thereby causing uneven force loading on each support leg as against the soft surface further causing a single chair leg for example to embed or penetrate into the soft surface potentially causing the chair to topple.

BACKGROUND OF INVENTION

Portable seating apparatus are well known and popular being used for sporting events such as football games, soccer games, golf, tennis, and the like. Other uses include sports activities like hunting, fishing, camping, and other similar activities. The primary aspects of a portable seating apparatus are that they are light in weight to be easily transportable and easily expanded into an open state and stowed into a closed or transport state, wherein at the same time having a fairly rigid framework structure when the seating apparatus is in the open state (for seating by the user) for stability and comfort of the user. Although there are numerous configurations for effecting the structural transition from and to the open and closed states known in the prior art for portable seating apparatus, currently the technology and the market seems to favor the scissors style structure that is pivotally connected to the midpoint of the support legs wherein operationally the support legs move inward and outward laterally while the support legs remain substantially parallel during this inward and outward movement. Further, the support legs are fully extended outwardly to form the open state of the portable seating apparatus having typically a flexible panel that conforms to the seat bottom and seat back portion when the support legs are fully extended outwardly. In putting the portable seating apparatus into the closed or stowed state the support legs are moved toward one another while the flexible seat bottom and back panel fold to allow the support legs to come together putting the portable seating apparatus into its stowed state.

Given the above popular scissors type folding structure for portable seating apparatus it is also utilized in the present invention, the focus of the present invention for the portable seating apparatus is upon the interface of the support legs with the surface that is of varying levels of softness. In looking at the prior art in the area of novel support leg interfaces with a surface support enhancement of portable seating apparatus, starting with the older design having a rigid seat bottom frame and back frame that are pivotally connected to one another (having a single plane of movement to collapse the portable chair) that collapse toward being adjacent to one another to be in the closed or stowed state is shown in U.S. Pat. No. 4,915,335 to Miles, wherein disclosed is a lawn chair stabilizer that has detachable tabs removably engaged to the support leg frame structure, wherein the tabs are operational to somewhat increase the surface area contact size and enhance lateral or side to side stability only. However, noting that Miles requires that the support legs be rigid and at least two of the support legs to have a fixed relationship to each other, see FIGS. 9 through 15. Furthermore, Miles does not enhance the portable chair stability if the user individual leans either forward of backward, again see FIGS. 9 through 15. Continuing for a similarly situated portable chair that folds to a closed or stowed state much like Miles, is in U.S. Pat. No. 5,087,095 to McFate wherein disclosed is a recreational chair for use in a beach environment or more specifically for use on a surface of sand. The portable chair in McFate is accompanied by certain attachments that are useful for sunning on a sandy surface, wherein these attachments are also provided for allowing easy transport of the chair upon the back of the user; see the abstract and FIGS. 2 and 3 in particular. A plurality of pockets are included in McFate that include a closable pouch located along the bottom of the chair for storing a length of foldable material or tarp suitable for placing upon a beach sandy surface for the purpose of lying thereon. The tarp in McFate may comprise any suitable material such as lightweight canvas or the like that is easily foldable into the pouch when not in use, with the tarp having a length of approximately six to seven feet being utilized in order to accommodate either a male or female body when lying full length thereon, see column 3, lines 3-13. McFate, also anchors the support legs in a tent pole fashion by driving a tent type stake that flexibly connects to the support leg, while this arrangement provides for preventing the chair from blowing away, it does not protect against the support leg from sinking into the sand surface, see FIG. 4 in particular.

Further in the portable chair apparatus prior art, in what appears to be a combination of Miles and McFate, however, leaning more towards Miles is disclosed in U.S. Pat. No. 5,513,900 to Iglesias that includes a planar chair stabilizing device for rotatable attachment to the ground level, pivotally horizontally attaching to an extending leg member portion of a chair. The device in Iglesias includes a stabilizing base and a gripping member fixed to the base having a slit in the portion of the gripping member not fixed to the base provides access to a central opening sized and shaped to receive the horizontally extending leg member portion, however allowing the chair to have free movement and not resisting forward or backward leaning, being the same drawback as Miles. The gripping member in Iglesias is also sufficiently firm to grip and hold the leg member portion within the central opening and to hold the base parallel to the leg member portion during use of the chair, wherein the base, on installation of the device, extends sufficiently outward to the side of the chair to prevent tipping of the chair to the side during use, see column 1, lines 52-67. The gripping member in Iglesias is sufficiently flexible to permit installation of the device by inserting the leg member portion through the slit into the central opening, see FIG. 5, additionally as in Miles, Iglesias requires a fixed rigid relationship between at least two support legs thus further limiting the folding structure options available to place the chair into the closed or stowed state.

Moving forward in looking at the prior art that is somewhat similar to McFate in function by providing a portable chair holddown as against the wind, in U.S. Pat. No. 6,290,197 to Newton, disclosed is a portable hold down device having weight mass which is connectable to a portable object, such as a portable folding chair, for maintaining the portable chair in a substantially stable condition so that the wind will not move and/or blow the portable chair about, see FIG. 1 for attachment to a current scissors folding type of portable chair with continuously substantially parallel support legs and FIG. 6 for attachment to a rigid frame pivoting seat bottom and rigid frame back folding type portable chair structure. The portable hold down device in Newton includes a portable hold down assembly having a weight sufficient to maintain the portable object in substantially stable condition when the hold down assembly is connected to the portable object, see Column 1, lines 43-52. The first connector assembly in Newton is removably connectable to the portable chair frame whereby when the first connector assembly is connected the portable chair support leg structure, wherein the portable chair is maintained in a substantially stable condition as against wind and the like. A second connector assembly in Newton is supported by at least one of the hold down assemblies and the first connector assembly so as to be extendable outwardly therefrom with the second connector assembly removably connectable to at least a portion of the portable chair having a different orientation than the portion of the portable object to which the first connector assembly is removably connectable, see FIG. 1 as previously described, with the attendant difficulty of attaching the weight. Thus as in McFate, Newton does not prevent the support legs of the portable chair apparatus from sinking into a soft surface, further, even though Miles and Iglesias do provide some increased surface area at the contact of the support leg on the surface, it is not much of an increase in surface area and does not provide for resistance against forward or backward movement of the individual user.

As an example of the previously discussed current scissors type of portable chair apparatus, wherein the support legs remain substantially parallel in going from the open state wherein the individual user can sit in the portable chair to the closed or stowed (transport) state and vice versa, see U.S. Pat. No. 6,505,885 to Tang that basically discloses the structural framework of the scissors mechanism, see in particular FIGS. 1 through 4 in going from the open state to the closed state. Note that in Tang, there are four small in area support leg rests that are adjacent to the surface, thus providing little support for the chair and individual user when the surface is a soft material, however, the focus in Tang is upon the scissors folding mechanism and not the surface contact supports. Also for a similar invention to Tang, see in U.S. Pat. No. 6,637,811 to Zheng, for a simpler version of Tang, Zheng however, using the scissors mechanism in a single axis of movement (laterally) and pivoting the support legs perpendicular to the lateral movement for a simpler design, while accomplishing the same function as Tang, albeit for a smaller portable chair.

What is needed is a portable chair apparatus that is adaptable to being functional upon a soft surface matter material, such as marsh type wet soil, snow, sand, and the like that can allow the individual user to sit comfortably and even potentially lean either backward or forward plus laterally side to side without fear of one chair leg sinking appreciably more than the other chair legs thereby upsetting the user who has to get out of the chair, remove the sunken leg from the surface matter and attempt to move the chair to another location with a harder more stable surface.

SUMMARY OF INVENTION

Broadly the chair support apparatus includes a first flexible planar panel having a first outer periphery portion and a second flexible planar panel having a second outer periphery portion, wherein the second flexible planar panel is partially affixed to the first flexible planar panel with the first and second flexible planar panels positioned parallel and adjacent to one another such that the first and second outer periphery portions are co-incident to one another. Also included in the chair support apparatus is a plurality of channels each having a lengthwise axis extending for the length of each one of the plurality of channels, wherein each lengthwise axis is positioned perpendicular to the first and second outer peripheries, and the lengthwise axis is extending fully across both of the first and second flexible planar panels. Wherein each of the plurality of channels is formed therebetween the first and second flexible planar panels bounded by the partial affixment that is parallel to the lengthwise axis.

Further included in the chair support apparatus is a plurality of straps, wherein each one of the plurality of straps is disposed within each one of the plurality of channels, wherein each one of the straps has a pair of extensions that extend beyond the first and second outer peripheries, each strap has a slip fit engagement within each channel allowing relative movement as between the first and second flexible planar panels and the strap only along the lengthwise axis. Wherein operationally each one of the strap extensions is removably engaged to a beam extension of the chair for drawing a plurality of portions of the first and second flexible planar panels taut resulting in a remaining plurality of portions of the first and second flexible planar panels drooping from the lengthwise movement as between the taut portions for the purpose of retaining accessories.

Broadly, the present invention can also be a portable chair apparatus that is adjacent to a surface, with the apparatus including a support structure that has a plurality of beam extensions, each beam extension having a longitudinal axis with a beam first end portion, a beam second end portion, and a beam mid portion positioned therebetween. The plurality of beam extensions form a paired "X" type crossing, wherein the beam extensions are pivotally connected to one another at a crossover point adjacent to each mid portion in the "X" type crossing. Further included in the portable chair apparatus is a flexible panel having a periphery portion that is attached therebetween a pair of the first end portions whose beam extensions form the paired "X" type crossing, wherein the pair of first end portions and the flexible panel are both adjacent to the surface. Also included in the portable chair apparatus is a flexible seat compartment element having an outer margin that is attached therebetween a pair of the second end portions whose beam extensions form the paired "X" type crossing. Operationally the portable chair apparatus has an open operational state with the flexible panel being drawn substantially taught thereby setting a distance between the first end portions, with the flexible panel forming an increased area of contact with the surface, while the flexible seat compartment element has slack between the second end portions while the portable chair apparatus is in the open state. The portable chair apparatus also having a stowed or closed state wherein the plurality of beam extensions are brought together with each longitudinal axis becoming more parallel by virtue of the flexible panel and the flexible seat compartment element collapsing.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
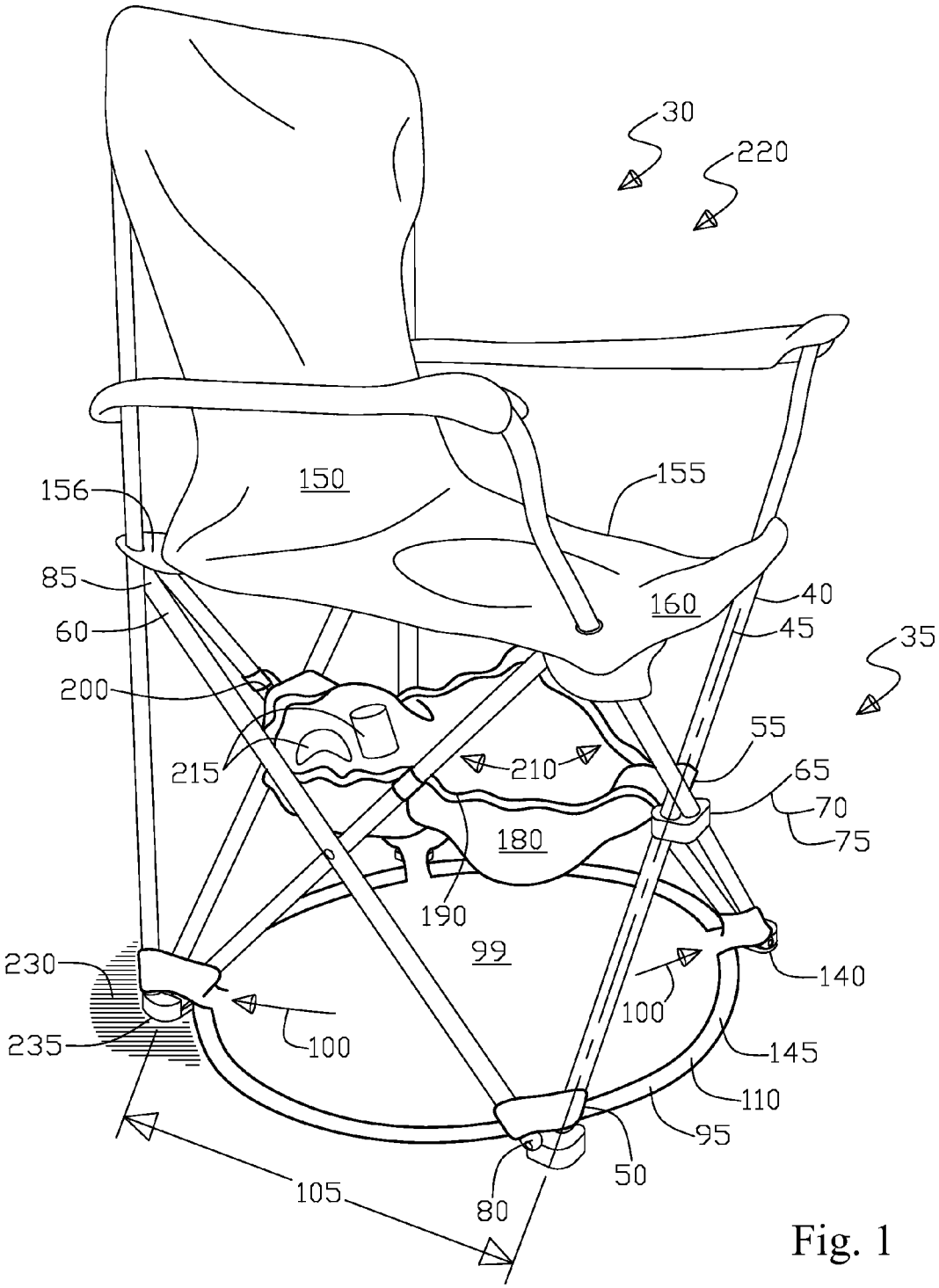
FIG. 1 shows a perspective view of the portable chair apparatus in the open state with the flexible panel forming a substantially rigid web area that is adjacent to the surface.

30 Portable Chair Apparatus
31 Chair support apparatus
35 Support structure
40 Beam extensions
45 Longitudinal axis
50 First end portion of beam extension 40
55 Mid portion of beam extension 40
60 Second end portion of beam extension 40
65 Paired "X" type crossing of the beam extensions 40
70 Pivotally connected beam extensions 40
75 Crossover point of the beam extensions 40
80 Pivotal connection of the first end portions 50
85 Pivotal connection of the second end portions 60
90 Flexible panel assembly
91 First flexible planar panel
92 Second flexible planar panel
95 Periphery portion of the flexible panel 90
96 First outer periphery portion
97 Second outer periphery portion
100 Substantially taut condition of the flexible panel 90
101 Plurality of channels
102 Lengthwise axis of channels 101
103 Length of channel 101
104 Taut portion of first 91 and second 92 flexible planar panels from the straps 125
105 Setting distance as between the first end portions 50
106 Concave or drooping portions of the first 91 and second 92 flexible planar panels as between taut portions 104
107 Partial affixment preferably via stitching
108 Segmented pocket
110 Increased area contact of the flexible panel 90 with the surface 230
115 Laminate construction of the flexible panel 90
120 Sheet material of the flexible panel 90
125 Broad flat reinforcing strap of the flexible panel 90
126 Slip fit movement of the strap 125
127 Extension of the strap 125
130 Substantially taut condition of the broad flat reinforcing strap 125
135 Oppositely disposed first end portions 50 of the beam extensions 40 for the attachment of the strap 125
140 Attachment therebetween of the flexible panel 90 and the first end portions 50
145 Substantially rigid web area of the flexible panel 90
150 Flexible seat compartment element
155 Outer margin of the flexible seat compartment element 150
156 Attachment of the outer margin 155 of the flexible seat compartment element 150
160 Slack condition of the flexible seat compartment element 150
165 Bringing together the plurality of beam extensions 40
170 Longitudinal axes 45 of the beam extension 40 becoming more parallel
175 Collapsing of the flexible panel 90 and the flexible seat compartment element 150
180 Flexible accessories tray
190 Outer edge portion of the flexible accessories tray 180

200 Attachment of the outer edge portion 190 of the flexible accessories tray 180
205 Drawstring of the flexible accessories tray 180
206 Outer peripheral channel
210 Concave shape of the flexible accessories tray 180
215 Accessories disposed within the flexible accessories tray 180 or flexible panel 90
220 Open operational state of the portable chair apparatus 30
225 Closed or stowed operational state of the portable chair apparatus 30
230 Surface
235 Adjacent to the surface 230
240 Soft state of the surface 230
245 User
249 Prior art portable chair apparatus
250 User 245 and prior art portable chair apparatus 249 sinking into the soft surface 240

DETAILED DESCRIPTION

Figure 2:
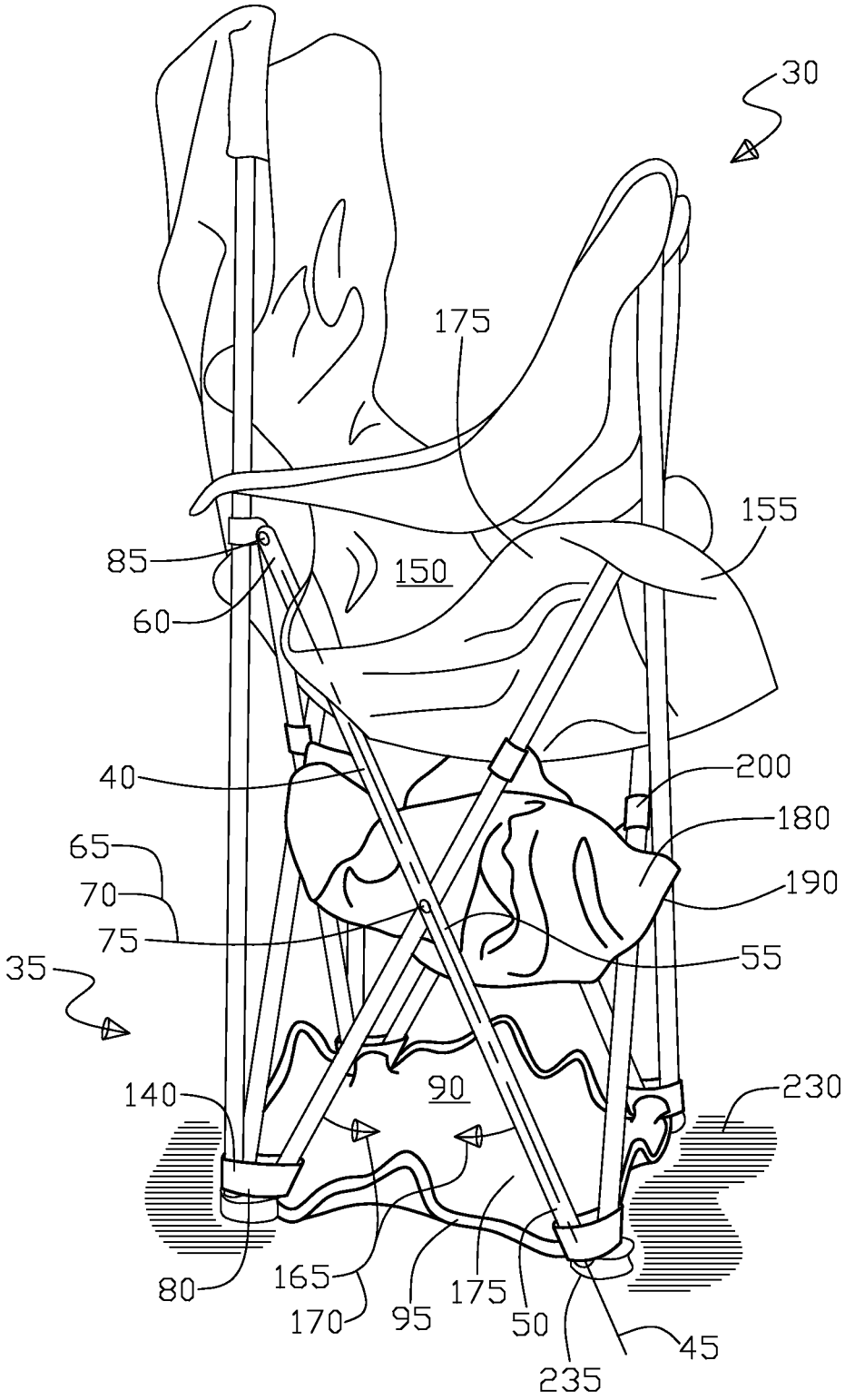
FIG. 2 shows a perspective view of the portable chair apparatus in the partially stowed state, being halfway between the open state and the closed state with the flexible panel and the flexible seat compartment element partially collapsing.
Figure 3:
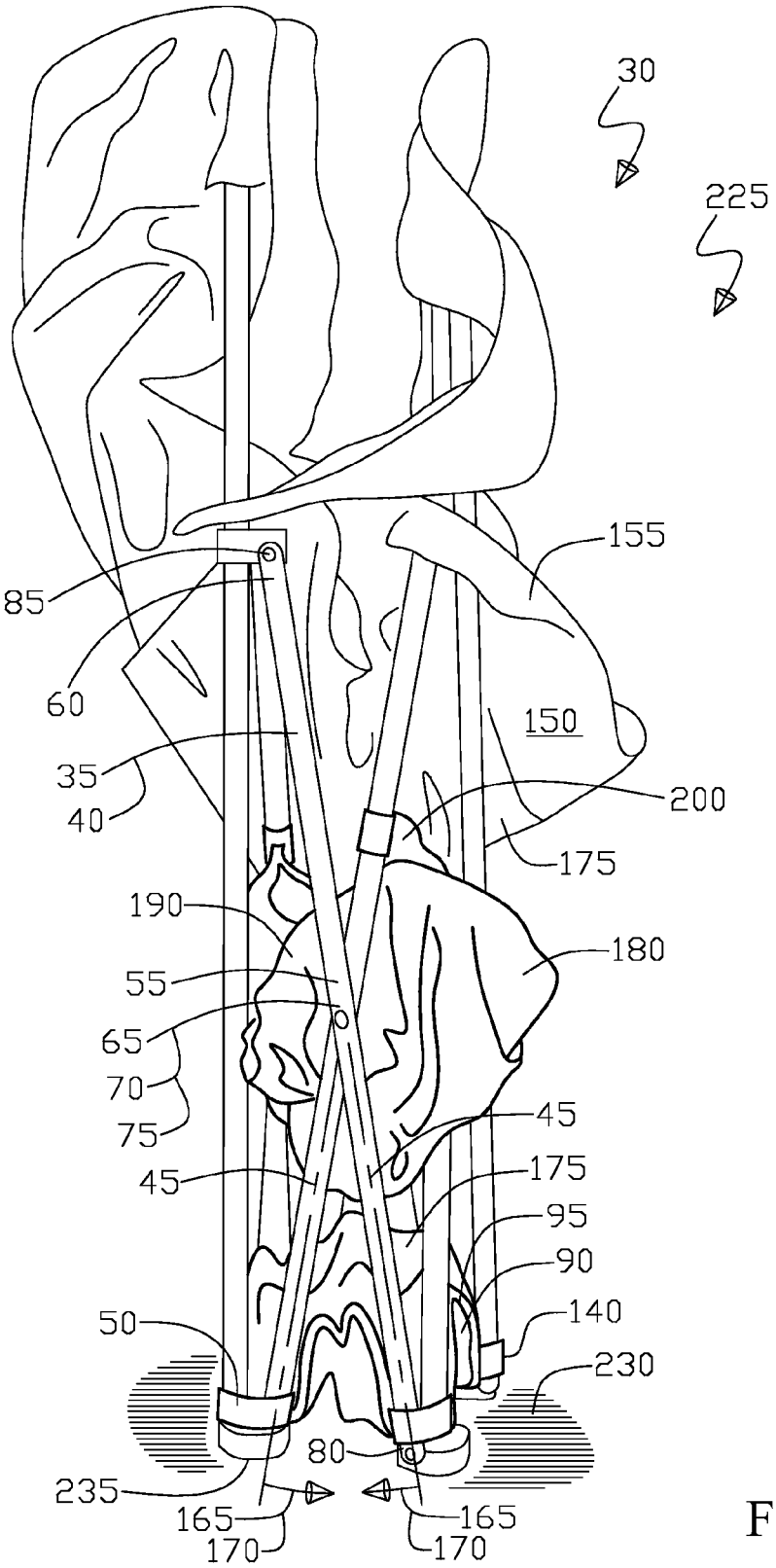
FIG. 3 shows a perspective view of the portable chair apparatus in the closed or stowed state with the flexible panel and the flexible seat compartment element collapsing.
Figure 4:
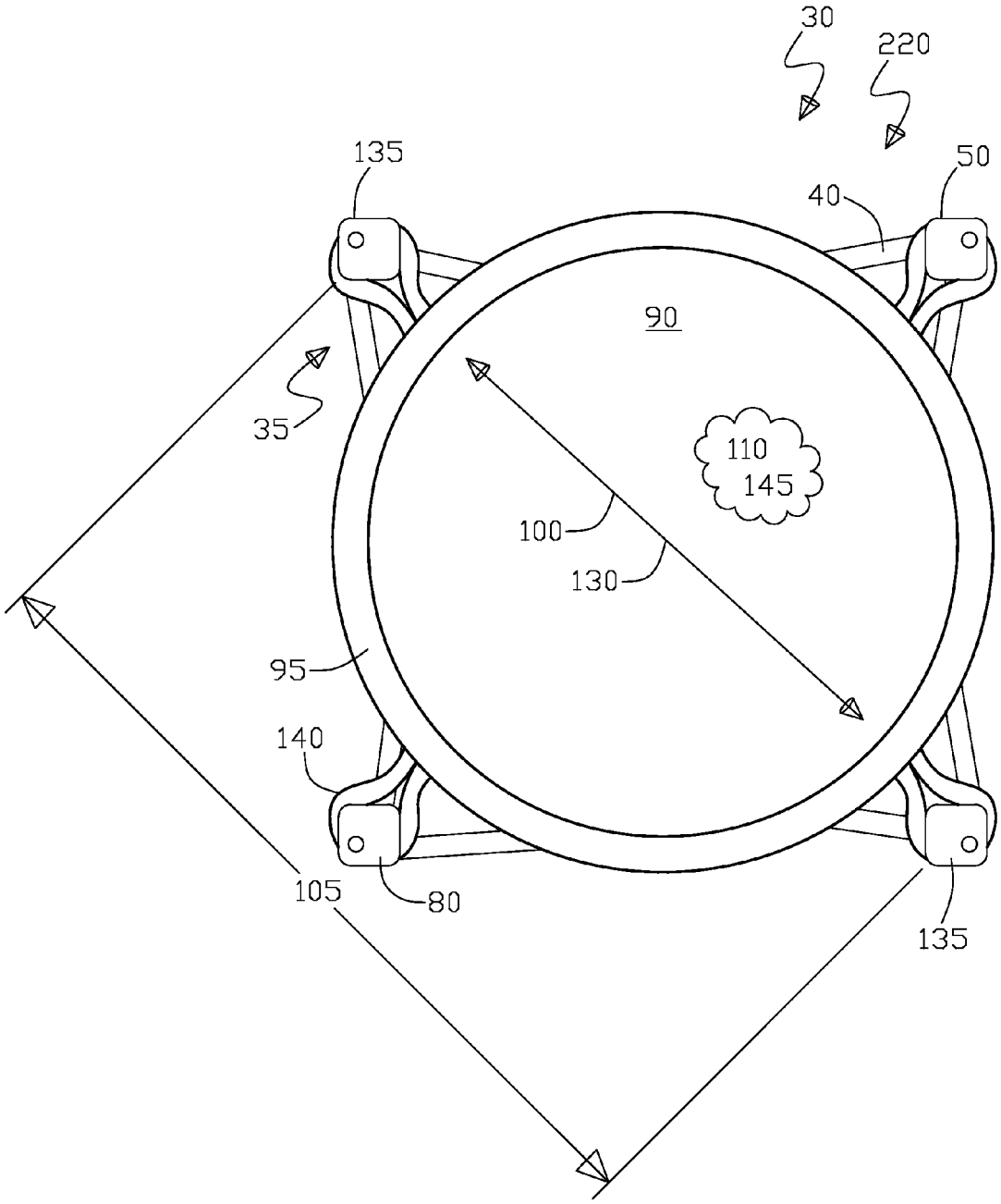
FIG. 4 shows a surface side view of the portable chair apparatus in the open state wherein predominately shown is the increased area contact of the flexible panel and the relationship of the beam extension pivotally connected first end portions.

With initial reference to FIG. 1 shown is a perspective view of the portable chair apparatus 30 in the open state 220 with the flexible panel 90 forming a substantially rigid web area 145 that is adjacent to the surface 230 and FIG. 2 shows a perspective view of the portable chair apparatus 30 in the partially stowed state, being halfway between the open state 220 and the closed state 225 with the flexible panel 90 and the flexible seat compartment element 150 partially collapsing 175. Continuing, FIG. 3 shows a perspective view of the portable chair apparatus 30 in the closed or stowed state 225 with the flexible panel 90 and the flexible seat compartment element 150 collapsing 175 and FIG. 4 shows a surface side view of the portable chair apparatus 30 in the open state 220 wherein predominately shown is the increased area contact 110 of the flexible panel 90 and the relationship of the beam extension 40 pivotally connected 80 first end portions 50.

Figure 5:
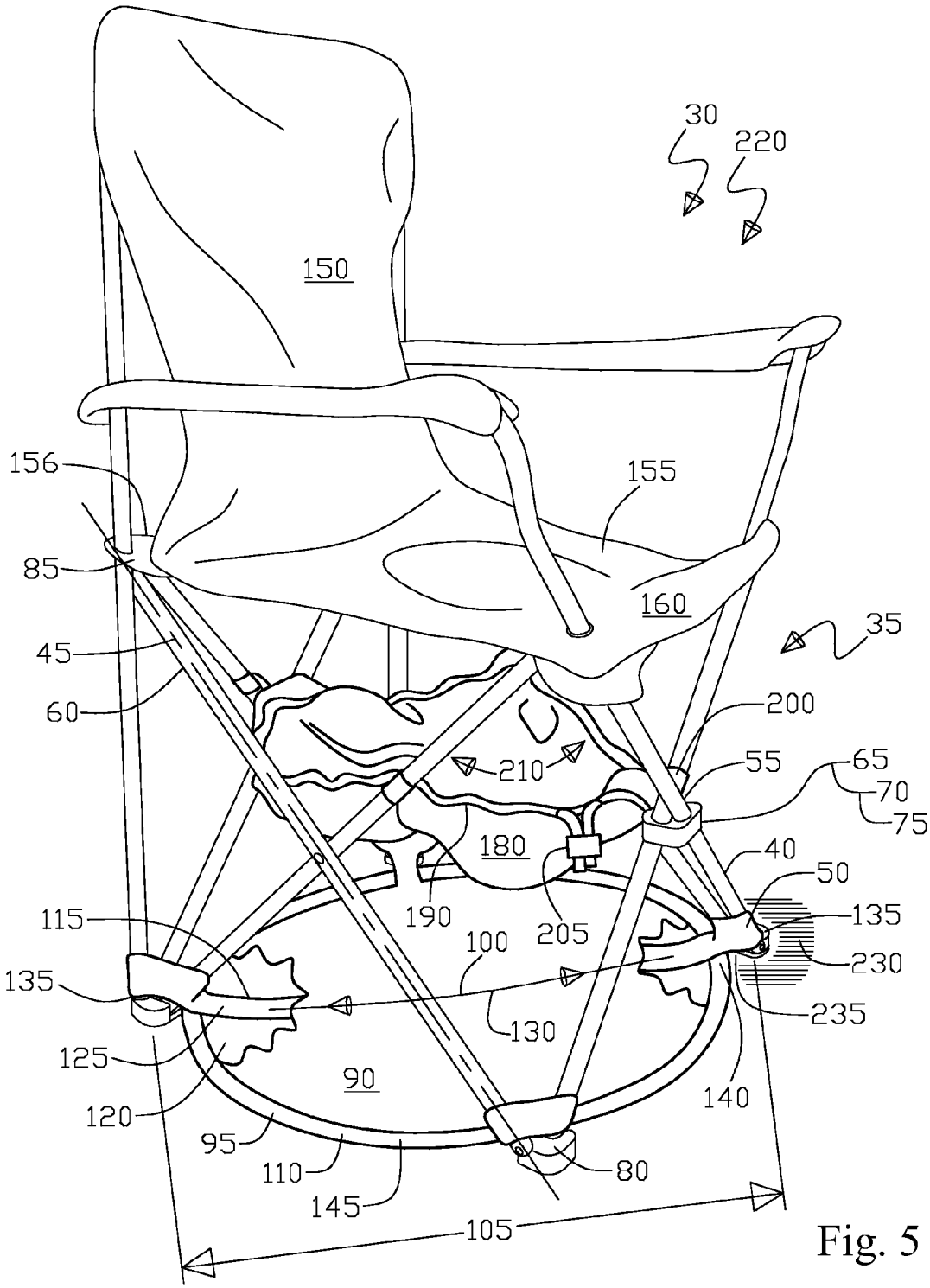
FIG. 5 shows a perspective view of the portable chair apparatus in the open state with the flexible panel straps and sheet forming a substantially rigid web area that is adjacent to the surface.
Figure 6:
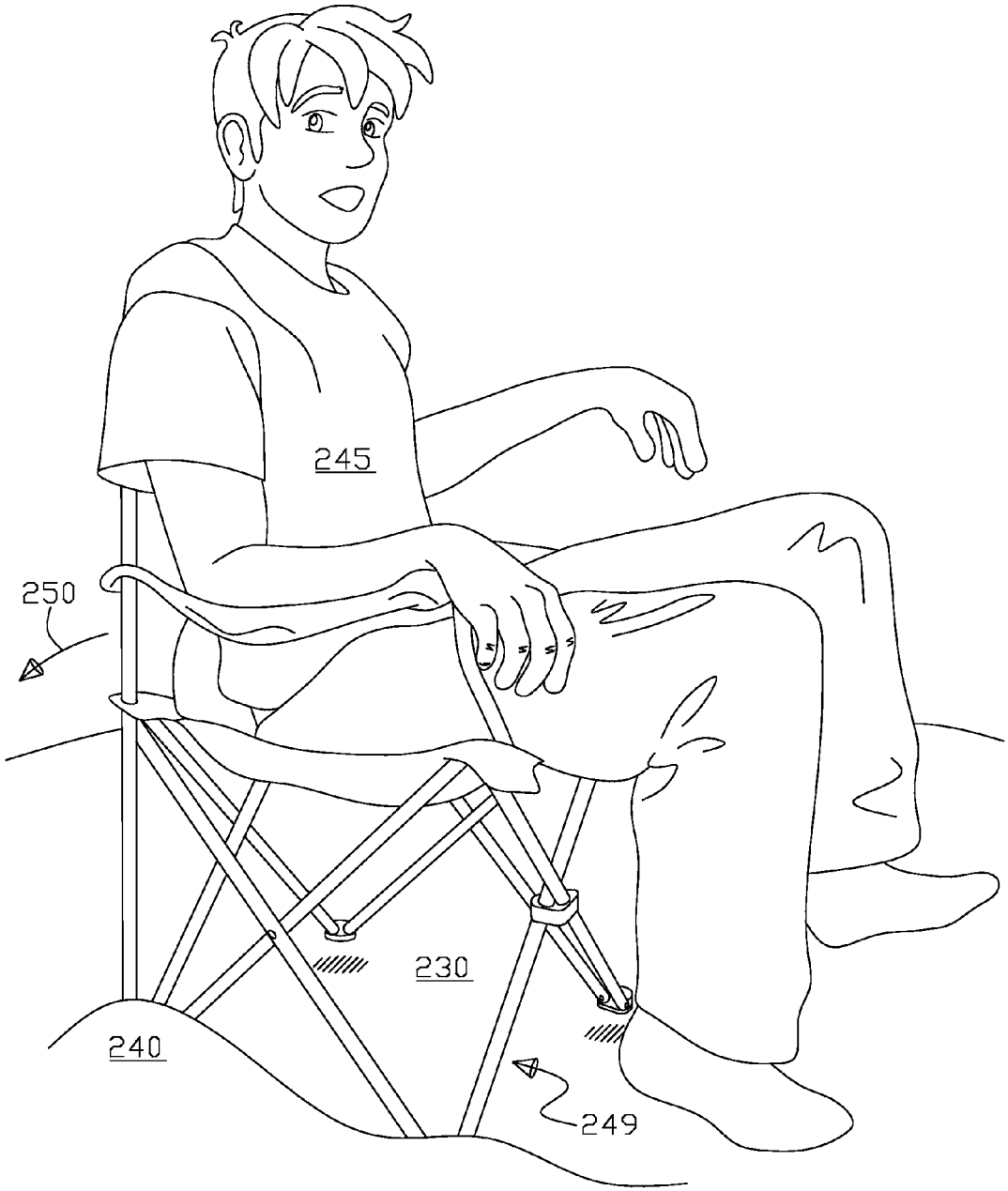
Fig. 6 (Prior Art)
FIG. 6 shows a perspective use view of a prior art version of the portable chair apparatus with the user sinking into the soft surface to their right side by virtue of the user's right side prior art chair legs embedding into the soft surface.
Figure 7:
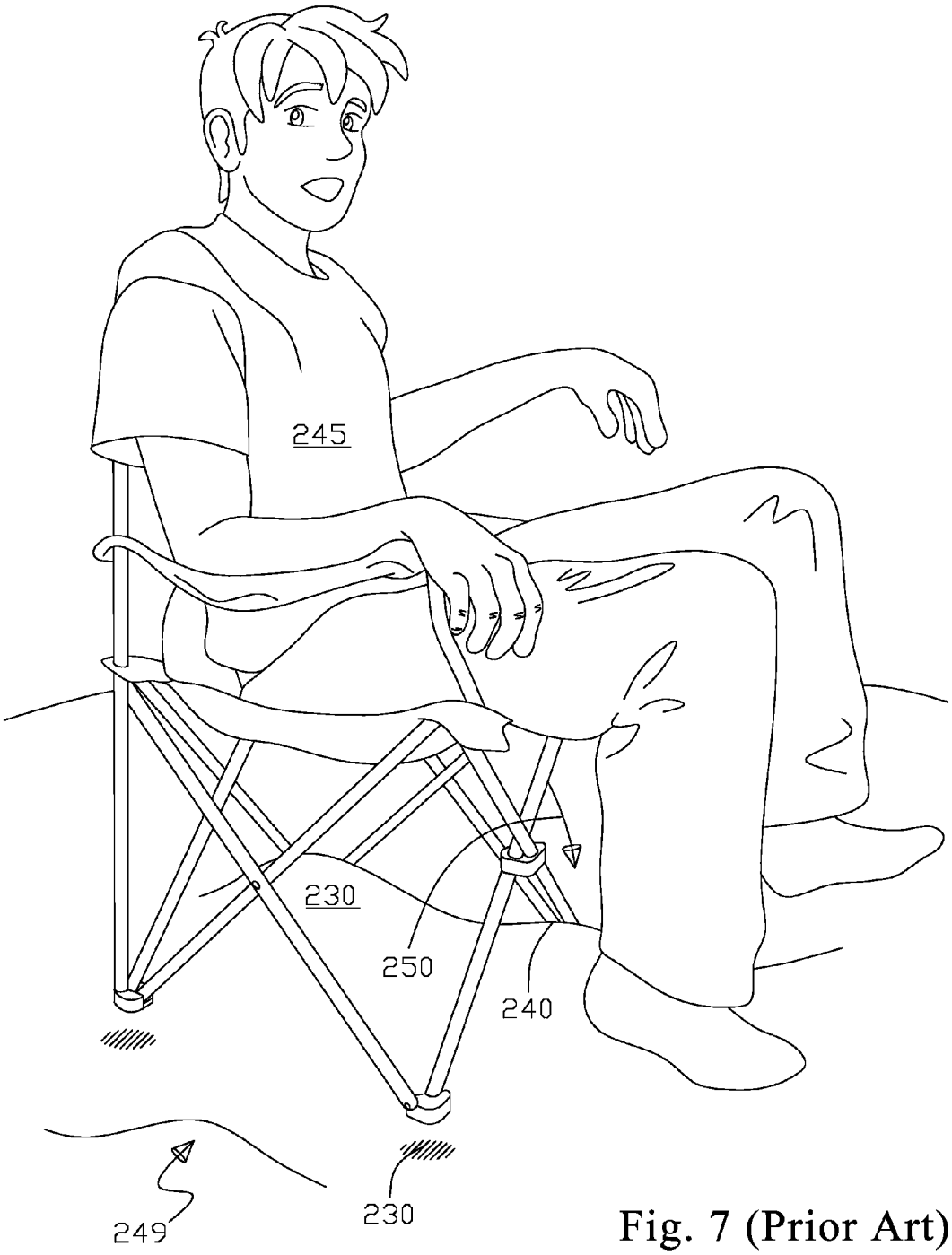
Fig. 7 (Prior Art)
FIG. 7 shows a perspective use view of the prior art version of the portable chair apparatus with the user sinking into the soft surface to their left side by virtue of the user's left side prior art chair legs embedding into the soft surface.
Figure 8:
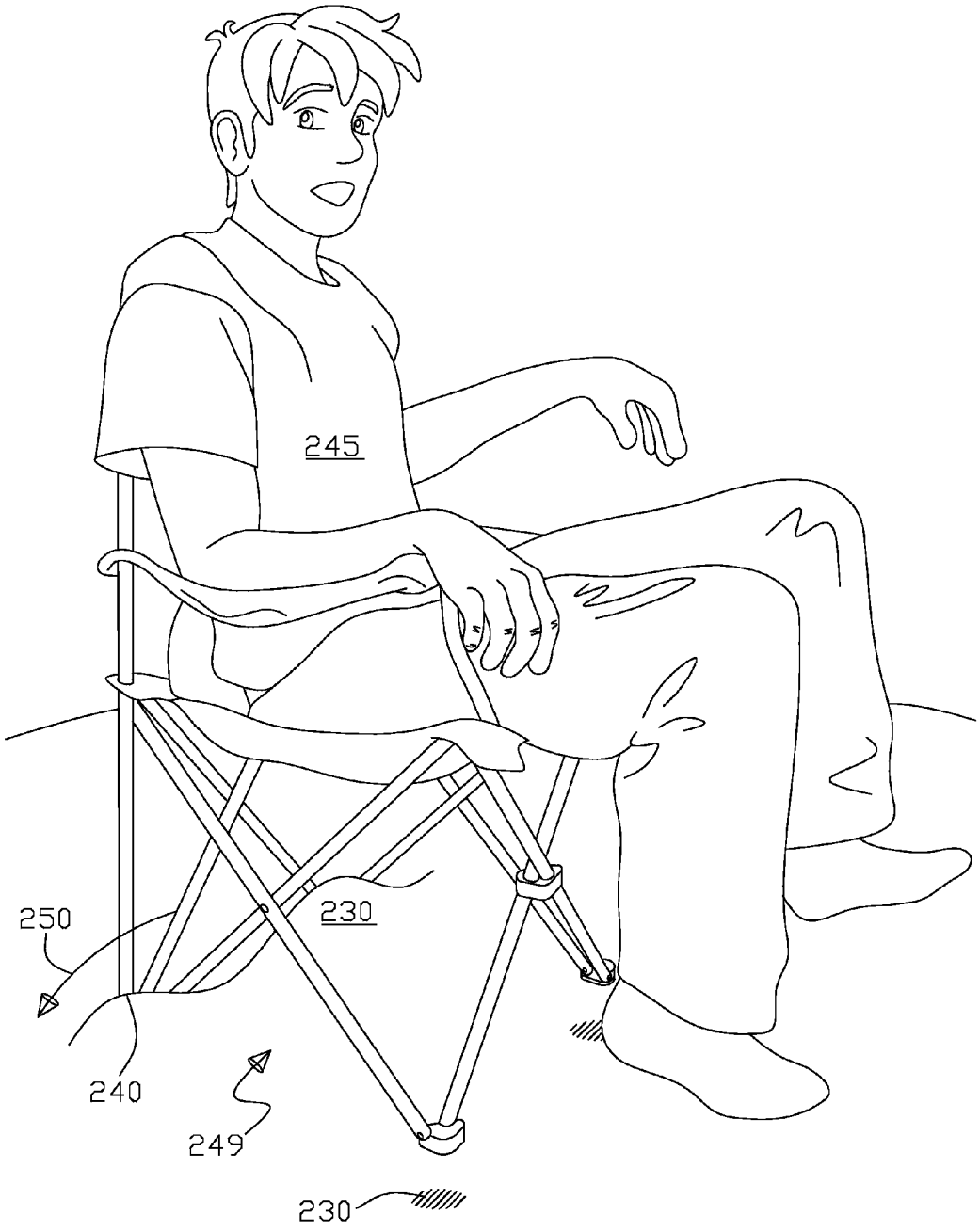
Fig. 8 (Prior Art)
FIG. 8 shows a perspective use view of the prior art version of the portable chair apparatus with the user sinking into the soft surface to their back side by virtue of the user's back side prior art chair legs embedding into the soft surface.

Next, FIG. 5 shows a perspective view of the portable chair apparatus 30 in the open state 220 with the flexible panel straps 125 and sheet 120 forming a substantially rigid web area 145 that is adjacent to the surface 230 and FIG. 6 shows a perspective use view of a prior art version of the portable chair apparatus 249 with the user 245 sinking into the soft surface 240 to their right side by virtue of the user's 245 right side prior art chair 249 legs embedding into the soft surface 240. Further, FIG. 7 shows a perspective use view of the prior art version of the portable chair apparatus 249 with the user 245 sinking into the soft surface 240 to their left side by virtue of the user's 245 left side prior art chair 249 legs embedding or sinking into the soft surface 240 and FIG. 8 shows a perspective use view of the prior art version of the portable chair apparatus 249 with the user 245 sinking into the soft surface 240 to their back side by virtue of the user's 245 back side prior art chair 249 legs embedding or sinking into the soft surface 240.

Figure 9:
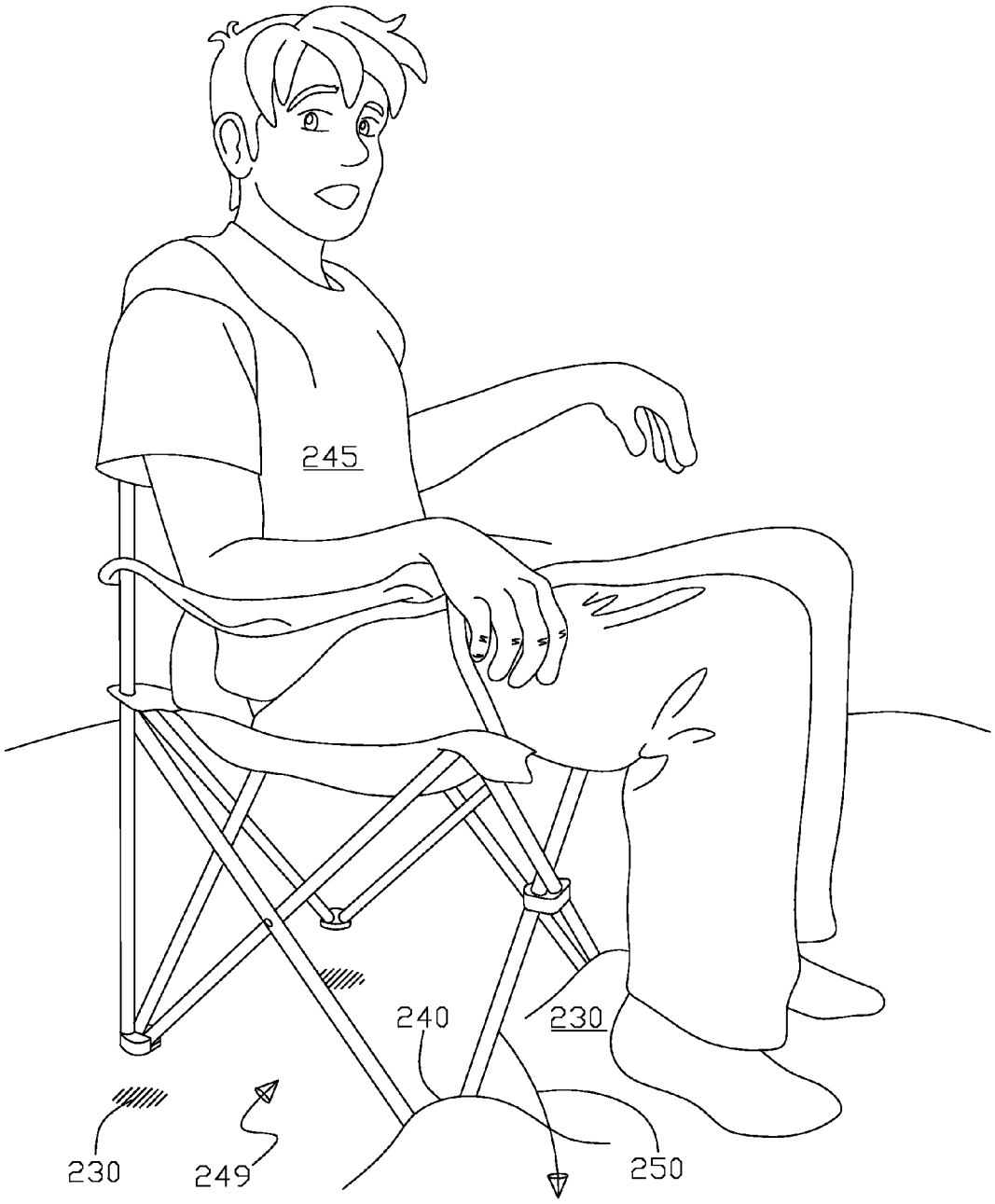
Fig. 9 (Prior Art)
FIG. 9 shows a perspective use view of the prior art version of the portable chair apparatus with the user sinking into the soft surface to their front side by virtue of the user's front prior art chair legs embedding into the soft surface.
Figure 10:
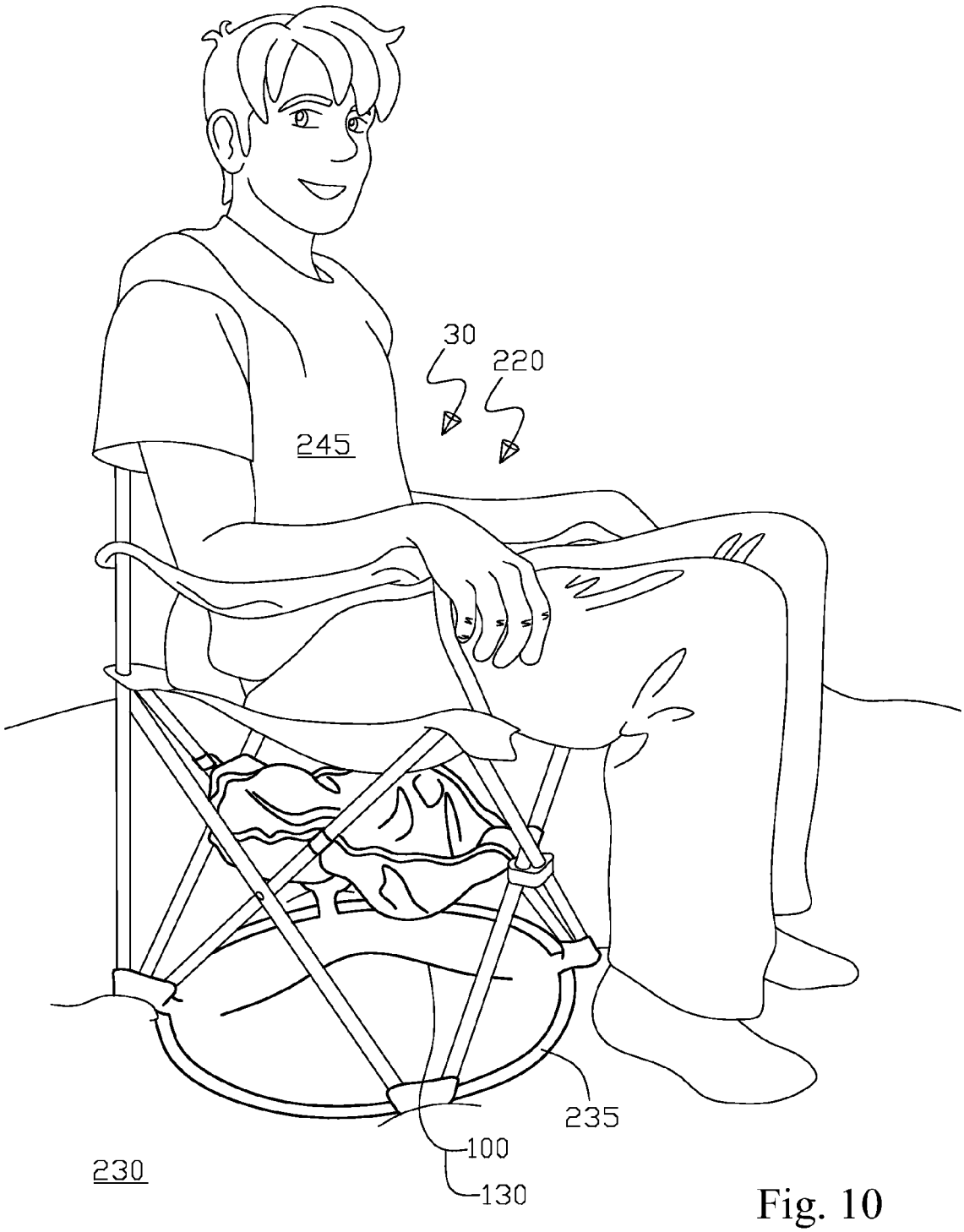
FIG. 10 is a perspective use view of the portable chair apparatus in the open state with the flexible panel forming a substantially rigid web area that is adjacent to the surface having a slight concave shape from contact with and downward force upon the soft surface from the combined weight of the user and the portable chair apparatus.

Next, FIG. 9 shows a perspective use view of the prior art version of the portable chair apparatus 249 with the user 245 sinking into the soft surface 240 to their front side by virtue of the user's 245 left front prior art chair 249 legs embedding or sinking into the soft surface 240. Further, FIG. 10 is a perspective use view of the portable chair apparatus 30 in the open state 220 with the flexible panel 90 forming a substantially rigid web area 145 that is adjacent 235 to the surface 230 having a slight concave shape from contact with and downward force upon the soft surface 240 from the combined weight of the user 245 and the portable chair apparatus 30.

Figure 11:
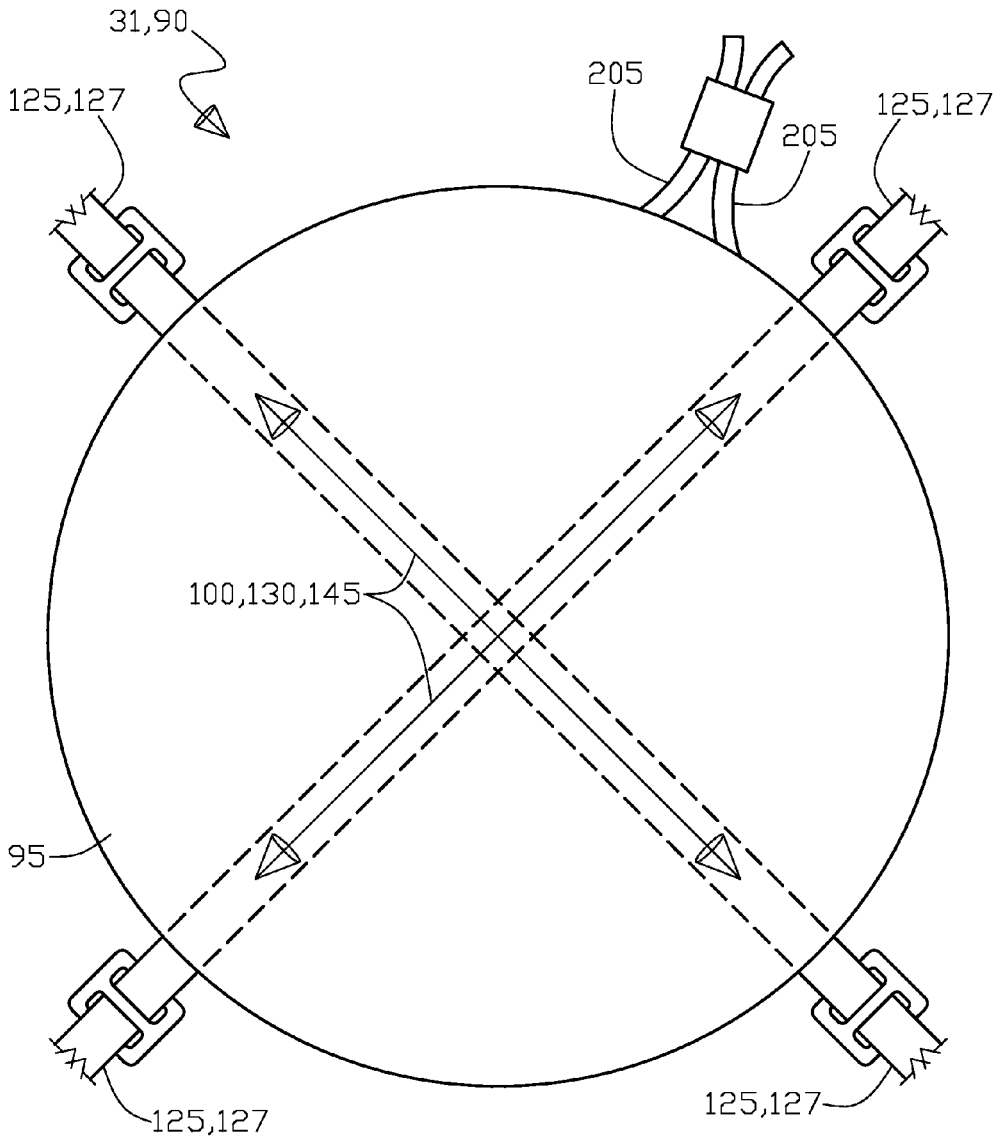
FIG. 11 shows a flat plan view of the chair support apparatus being the flexible panel assembly including the peripheral portion, the straps, the strap extensions, the taut condition of the straps, and the taut condition of a portion of the flexible panel or combined first and second flexible planar panels, and the drawstring.
Figure 12:
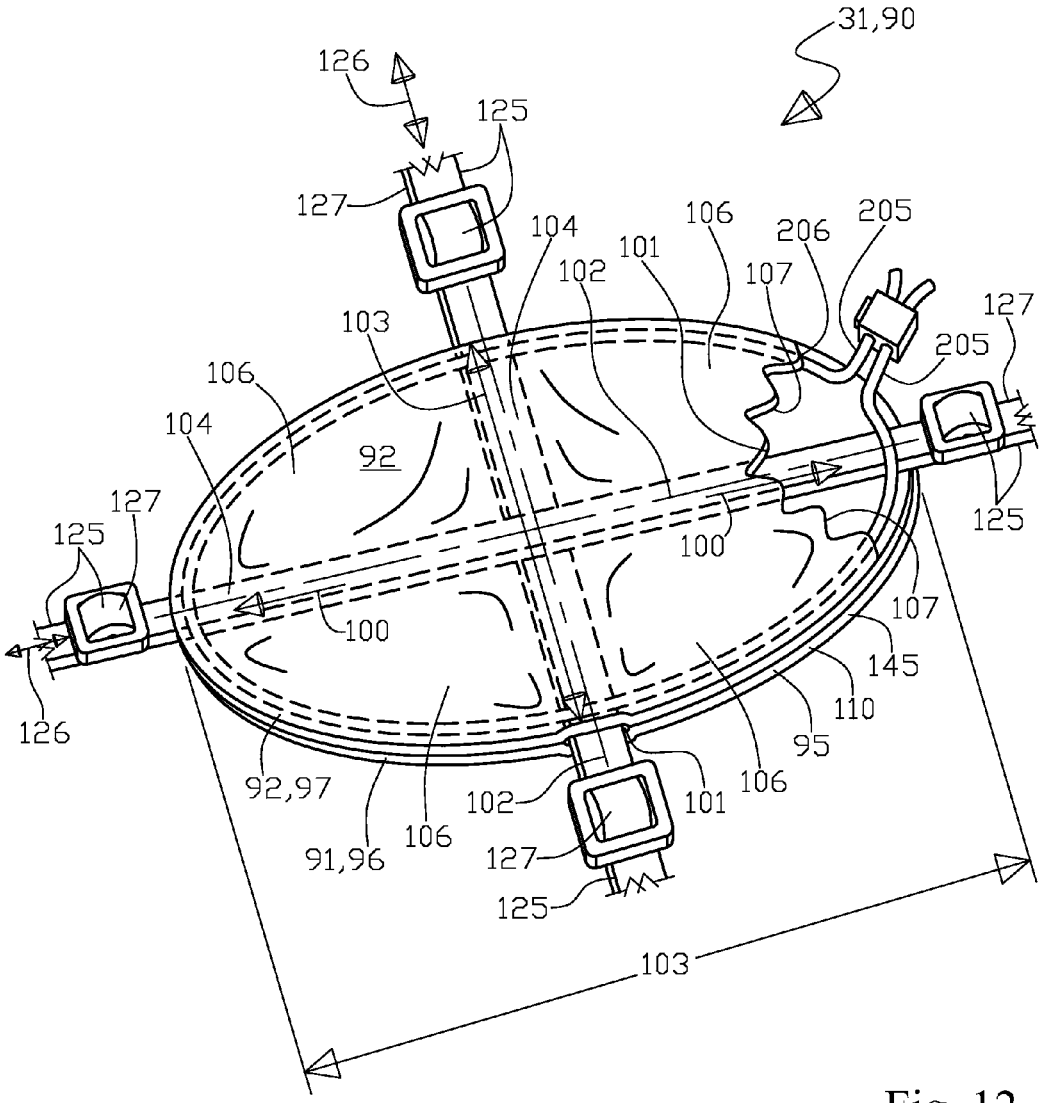
FIG. 12 shows a perspective view of the chair support apparatus being the flexible panel assembly including the first and second flexible planar panels, the peripheral portion being the first and second outer periphery portions, the partial affixment of the first and second flexible planar panels, the channels for the straps, the channel length, the lengthwise axis of the channel, the straps, the strap extensions, the slip fit movement of the straps, the taut condition of the straps, and the taut condition of a portion of the flexible panel or combined first and second flexible planar panels, the drawstring outer peripheral channel, plus the drawstring when combined with the taut condition forms the concave or drooping portions of the first and second flexible planar panels.

Next, FIG. 11 shows a flat plan view of the chair support apparatus 31 being the flexible panel assembly 90 including the peripheral portion 95, the straps 125, the strap extensions 126, the taut condition 104 of the straps 125, and the taut condition 104 of a portion of the flexible panel 90 or combined first 91 and second 92 flexible planar panels, and the drawstring 205. Continuing, FIG. 12 shows a perspective view of the chair support apparatus 31 being the flexible panel assembly 90 including the first 91 and second 92 flexible planar panels, the peripheral portion 95 being the first 96 and second 97 outer periphery portions, the partial affixment 107 of the first 91 and second 92 flexible planar panels, and the channels 101 for the straps 125. Further, FIG. 12 shows the channel 101 length 103, the lengthwise axis 102 of the channel 101, the straps 125, the strap extensions 127, the slip fit movement 126 of the straps 125, the taut condition 100, 104 of the straps 125, and the taut condition 104 of a portion of the flexible panel 90 or combined first 91 and second 92 flexible planar panels, the drawstring 205 outer peripheral channel 206, plus the drawstring 205 when combined with the taut condition 105 forms the concave or drooping portions 106 of the first 91 and second 92 flexible planar panels.

Figure 13:
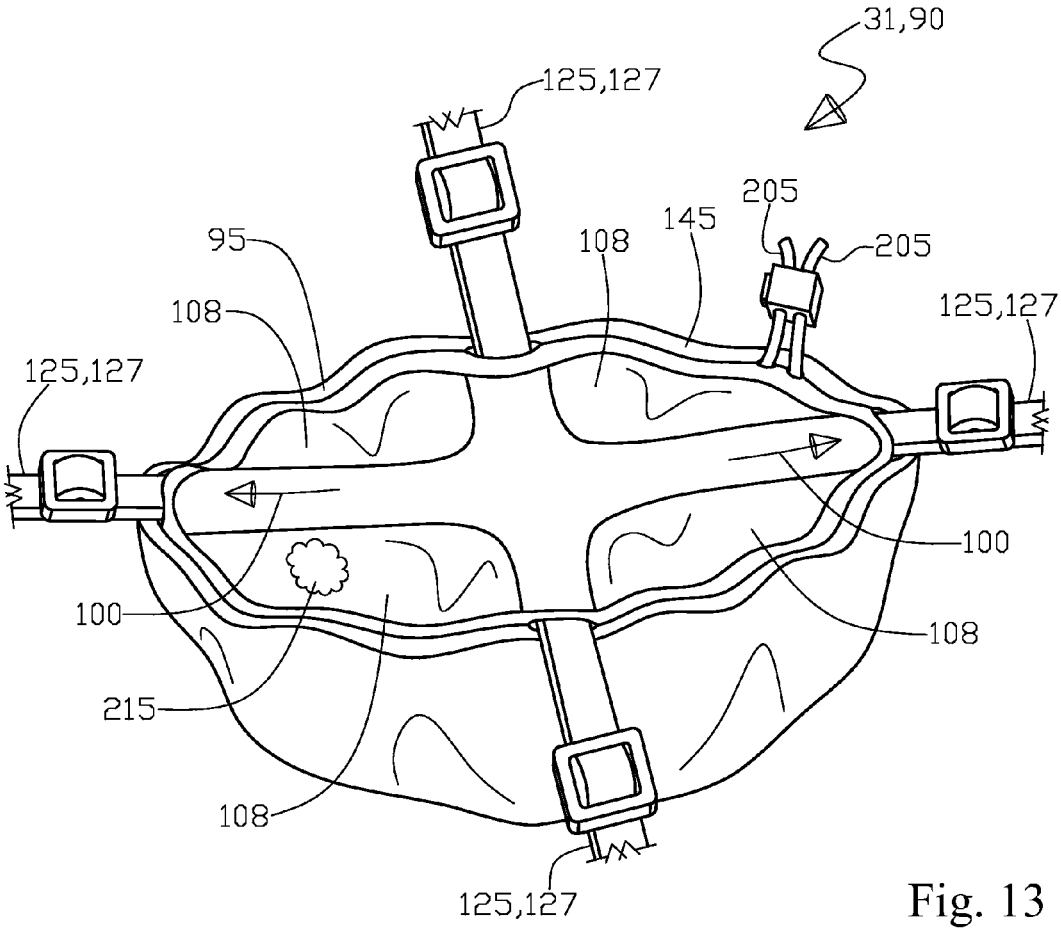
FIG. 13 is a perspective view to specifically show the chair support apparatus being the flexible panel assembly with the plurality of segmented pockets formed between the taut portions formed via the strap being drawn taut and portions of the first and second flexible planar panels and portions of the drawstring pulled taut within the outer peripheral channel wherein the first and second flexible planar panels utilizing the slip fit movement of the strap relative to the first and second flexible planar panels and the drawstring within the outer peripheral channel.

Continuing, FIG. 13 is a perspective view to specifically show the chair support apparatus 31 being the flexible panel assembly 90 with the plurality of segmented pockets 108 formed between the taut portions 104 formed via the strap 125 being drawn taut and portions of the first 91 and second 92 flexible planar panels and portions of the drawstring 205 pulled taut within the outer peripheral channel 206 wherein the first 91 and second 92 flexible planar panels utilizing the slip fit movement 126 of the strap 125 relative to the first 91 and second 92 flexible planar panels and the drawstring 205 within the outer peripheral channel 206.

Broadly the present invention, as best shown in FIGS. 1 through 4, is of a portable chair apparatus 30 that is positioned adjacent 235 to a surface 230, with the portable chair apparatus 30 including a support structure 35 that includes a plurality of beam extensions 40, each of the beam extensions 40 having a longitudinal axis 45 with a beam first end portion 50, a beam second end portion 60, and a beam mid portion 55 positioned therebetween. The plurality of beam extensions 40 form a paired "X" type crossing 65, wherein the beam extensions 40 are pivotally connected 70 to one another at a crossover point 75 adjacent to each of the mid portions 55 in the "X" type crossing 65. Further included in the portable chair apparatus 30 is a flexible panel 90 having a periphery portion 95 that is attached 140 therebetween a pair of the first end portions 50 whose beam extensions 40 form the paired "X" type crossing 65, wherein the pair of first end portions 50 and the flexible panel 90 are both adjacent to the surface 230. Also included in the portable chair apparatus 30 is a flexible seat compartment element 150 having an outer margin 155 that is attached 156 therebetween a pair of the second end portions 60 whose beam extensions 40 form the paired "X" type crossing 65. Noting that the portable chair apparatus as previously described could have only a single paired "X" type crossing 65, seeing use as a stool type chair, although the Figures show the portable chair apparatus 30 with a plurality of paired "X" type crossings 65.

Wherein operationally, the portable chair apparatus 30 has an open operational state 220, see FIG. 1 with the flexible panel 90 being drawn substantially taut 100 thereby setting a distance 105 between the first end portions 50, with the flexible panel 90 forming an increased area contact 110 with the surface 230, see FIG. 4, while the flexible seat compartment element 150 has a slack condition 160 between the second end portions 60. Continuing, the portable chair apparatus 30 also having a stowed state 225, see FIG. 3, wherein the plurality of beam extensions 40 are brought together 165 with each longitudinal axis 45 becoming more parallel 170 by virtue of the flexible panel 90 and said flexible seat compartment element 150 collapsing 175, see FIG. 2 for the transition between the open state 220 and the closed state 225. The preferred materials of construction for the beam extensions 40 and their associated pivotal connections 70, 80, and 85 are carbon steel that is coated with a weatherproof surface, alternative materials would include any material that has strength to support a heavy user 245 such as 250+ pounds and is weatherproof. The preferred material of construction for the flexible seat compartment element 150 is a heavy nylon type weaved fabric similar to a tarp material or any other material that is weatherproof, has strength to support a heavy user 245 such as 250+ pounds, and has some degree of flexibility.

As a further option for the portable chair apparatus 30, can further comprise a plurality of paired "X" type crossing sets 65 of the beam extensions 40 wherein the beam extension first end portions 50 are all attached to the flexible panel 90 periphery 95 and the beam extension second end portions 60 are all attached 156 to the outer margin 155 of the flexible seat compartment element 150, see FIG. 1. Also as an option on the portable chair apparatus 30 is to have the beam extension first end portions 50 pivotally connected 80 to one another as between each the paired "X" type crossing 65 sets, see FIG. 1. As an optional follow on to this the portable chair apparatus 30 can have the beam extension second end portions 60 being pivotally connected 85 to one another as between each paired "X" type crossing 65 sets, also see FIG. 1. Or as an option to combining the beam extension first end portions 50 pivotal connections 80 and the beam extension second end portions 60 pivotal connections 85 of the portable chair apparatus 30 such that the beam extension first end portions 50 are pivotally connected 80 to one another as between each paired "X" type crossing 65 sets and the beam extension second end portions 60 are pivotally connected 85 to one another as between each paired "X" type crossing 65 sets, also see FIG. 1.

Looking at more detail on the flexible panel 90 of the portable chair apparatus 30 wherein the flexible panel 90 is preferably constructed of a laminate 115 including a sheet material 120 with a broad flat reinforcing strap 125 that is substantially taut 100 as between the beam extension first end portions 50 when the portable chair apparatus 30 is in the open state 220, see FIGS. 4 and 5. Further, on the portable chair apparatus 30 for the flexible panel 90 optionally the preferred materials of construction the flexible panel 90 can be constructed of a laminate 115 including a sheet 120 material as previously described, however, with a plurality of broad flat reinforcing straps 125 that are all substantially taut 100 as between opposing or oppositely positioned beam extension first end portions 50 when the portable chair apparatus 30 is in the open state 220, such that the flexible panel 90 plurality of straps 125 all have a substantially taut condition 130 from the attachments 140 of the straps 125 to the oppositely disposed 135 beam extension first end portions 50. Thereby the straps 125 setting the distance 105 that the first end portions 50 would spread apart by providing a "gauge" for the stopping point of the open state 220 of the portable chair apparatus 30, see again FIGS. 4 and 5. Note that this "gauge" of the flexible panel 90 means that the flexible seat component element 150 does not act as the "gauge" in setting the distance 105 that the first end portions 50 would spread apart, see FIGS. 4 and 5, as does the prior art portable chair apparatus 249, please see FIGS. 6 through 9, meaning that the only restriction in the prior art chair 249 is the flexible seat and back element 150 for holding the distance 105 that the first end portions 50 would spread apart. The preferred material of construction for the sheet 120 is a heavy nylon type weaved fabric similar to a tarp material or any other material that is weatherproof, has strength equal to or better than the unit psi loading as described below, and has some degree of flexibility. The preferred material of construction for the reinforcing strap 125 is a heavy nylon type weaved fabric similar to a cargo tie down strap or seat belt type material or any other material that is weatherproof, has good tensile strength of about 100 pounds force or more, and also has some degree of flexibility.

This additionally results in the flexible panel 90 forming a substantially rigid web area 145; see FIG. 5, as against the surface 230 which in turn increases the load bearing area of the portable chair apparatus 30 that is in contact with the surface 230, especially see FIG. 4. This is especially important when the surface is in a soft state 240, such as soggy soil, snow, sand, and the like, wherein a conventional portable chair leg would quickly sink into the surface causing extreme unbalance and discomfort for the individual user 245, wherein the substantially rigid panel 90 (when the portable chair apparatus 30 is in the open state 220) adds significant surface area for the load (being the combined weight of the chair 30 and the user 245) to in effect drop the high unit load of a prior art portable chair apparatus 249 footprint on the surface 230, see FIGS. 6 through 10, (typically in pounds per square inch-psi) of 25 psi for a conventional prior art portable chair 249 (assuming a 200 pound prior art chair 249 and user 245 combined weight and a total of 8 square inches of chair leg contact surface area adjacent to the surface 230) to less than 1 psi for the present invention 30 (assuming the same combined weight of 200 pounds and a total surface contact area 110 of about 262 square inches) due to the panel 90, thus making the present invention portable chair 30 more usable in a soft surface 240 situation by helping to prevent a portable chair leg first end portion 50 from excessively sinking into the soft surface 240 from the combined weight of the user 245 and the portable chair apparatus 30.

Note that the flexible panel 90 rigidity 145 is reinforced in several ways, first by the weight of the user 245 acting to increase the distance 105 as between the beam extension 40 first end portions 50 which acts to increase the taut 100 condition of the flexible panel 90, see FIGS. 1, 4, 5, and 10, plus secondly by the flexible panel 90 assuming a slightly concave profile on its side adjacent to the surface 230, see FIG. 10, wherein the beam extension first end portions 50 are somewhat embedded into the soft surface 240 deeper than the flexible panel 90 thus the flexible panel 90 will want to pull the beam extension first end portions 50 inward with movement toward one another 165, see FIG. 2, as the flexible panel 90 has a higher bearing load as being adjacent to the soft surface 240 with more contact force, however, this movement 165 will be resisted by the weight of the user 245 in the chair 30 and the beam extension first end portions 50 being semi embedded in the soft surface 240. This substantial rigidity of the flexible panel 90 is operational to maintain the increased surface area 110 to help prevent the portable chair apparatus 30 from sinking into the soft surface 240. This prior art chair 249 leg sinking into the soft surface 240 issue can also be exacerbated by the user 245 typically leaning to their right, left, forward, or backward in their normal use of the chair 249 which effectively can double the unit load in psi as between the chair leg contacting the soft surface 240 as previously discussed, see FIGS. 6 through 9, resulting in going from 25 psi to 50 psi which acts to worsen the prior art chair 249 leg sinking into the soft surface 240 situation.

As an added option, the portable chair apparatus 30 can further comprise a flexible accessories tray 180 having an outer edge portion 190 that is attached 200 therebetween a pair of the beam extension mid portions 55, see FIGS. 1 through 3, and 5. Continuing, on the portable chair apparatus 30 wherein the flexible accessories tray 180 can further include a drawstring 205 positioned adjacent to outer edge portion 190 that is operational to further enhance a concave shape 210 of the flexible accessories tray 180 that is disposed opposite of the surface 230 for the purpose of helping to retain accessories 215, which can be suntan lotion, drinks, snacks, keys, and the like, see FIG. 1. The preferred material of construction for the flexible accessories tray 180 is a nylon type weaved fabric similar to a tarp material or any other material that is weatherproof and has some degree of flexibility.

Broadly, in looking at particular at FIGS. 11, 12, and 13, the chair support apparatus 31 includes a first flexible planar panel 91 having a first outer periphery portion 96 and a second flexible planar panel 92 having a second outer periphery portion 97, wherein the second flexible planar panel 92 is partially affixed 107 to the first flexible planar panel 91 with the first 91 and second 92 flexible planar panels positioned parallel and adjacent to one another such that the first 96 and second 97 outer periphery portions are co-incident to one another, see FIGS. 11 and 12. Also included in the chair support apparatus 31 is a plurality of channels 101 each having a lengthwise axis 102 extending for the length 103 of each one of the plurality of channels 101, wherein each lengthwise axis 102 is positioned perpendicular to the first 96 and second 97 outer peripheries, and the lengthwise axis 102 is extending fully across both of the first 91 and second 92 flexible planar panels, see FIG. 12. Wherein each of the plurality of channels 101 is formed therebetween the first 91 and second 92 flexible planar panels bounded by the partial affixment 107 that is parallel to the lengthwise axis 102, again see FIG. 12.

Again looking at FIGS. 11, 12, and 13, further included in the chair support apparatus 31 is a plurality of straps 125, wherein each one of the plurality of straps 125 is disposed within each one of the plurality of channels 101, wherein each one of the straps 125 has a pair of extensions 127 that extend beyond the first 96 and second 97 outer peripheries, each strap 125 has a slip fit engagement 126 within each channel 101 allowing relative movement 126 as between the first 91 and second 92 flexible planar panels and the strap 125 only along the lengthwise axis 102. Wherein operationally each one of the strap 125 extensions 127 is removably engaged to a beam extension 40 of the chair for drawing a plurality of portions of the first 91 and second 92 flexible planar panels taut 100, 104 resulting in a remaining plurality of portions being segmented pockets 108 of the first 91 and second 92 flexible planar panels drooping 107 from the lengthwise movement 126 as between the taut portions 104 resulting from the slack in the first 91 and second 92 flexible planar panels for the purpose of retaining accessories 215, as best shown in FIGS. 12 and 13.

CONCLUSION

Accordingly, the present invention of a chair support apparatus has been described with some degree of particularity directed to the embodiments of the present invention. It should be appreciated, though, that the present invention is defined by the following claims construed in light of the prior art so modifications or changes may be made to the exemplary embodiments of the present invention without departing from the inventive concepts contained therein.

The invention claimed is:

1. A chair support apparatus, comprising:

(a) a chair having a seat, said chair also includes a support structure having a plurality of beam extensions, wherein each said beam extension has a first end portion, a mid portion, and a second end portion, such that said first end portion is adjacent to a surface and said second end portion is attached to said seat;

(b) a first flexible planar panel having a first outer periphery portion;

(c) a second flexible planar panel having a second outer periphery portion, wherein said second flexible planar panel is partially affixed to said first flexible planar panel with said first and second flexible planar panels positioned parallel and adjacent to one another such that said first and second outer periphery portions are co-incident to one another;

(d) a plurality of channels each having a lengthwise axis extending for the length of each one of said plurality of channels, wherein each said lengthwise axis is positioned perpendicular to said first and second outer peripheries, and said plurality of channels extending fully across both of said first and second flexible planar panels, wherein each of said plurality of channels is disposed between said first and second flexible planar panels bounded by said partial affixment that is parallel to said lengthwise axis; and (e) a plurality of straps, wherein each one of said plurality of straps is disposed within each one of said plurality of channels, resulting in a single strap disposed within each channel, wherein each one of said straps has a pair of extensions that extend beyond said first and second outer peripheries, each said strap has a slip fit engagement within each said channel allowing relative movement between said partially affixed first and second flexible planar panels together and said strap only along said lengthwise axis, wherein each one of said strap extensions is removably engaged to each one of said first end portions of said beam extensions of said chair, resulting in a taut condition of said straps corresponding to a plurality of portions of said first and second flexible planar panels being taut resulting in a remaining plurality of portions of said first and second flexible planar panels forming drooping portions being disposed between said taut first and second flexible planar panel portions for the purpose of operationally retaining accessories in said drooping portions.

2. A chair support apparatus according to claim 1 further comprising a drawstring that is disposed within an outer peripheral channel that is formed between said first and second outer periphery portions being bounded by said partial affixment, wherein operationally when said drawstring is drawn taut a segmented pocket is formed that is bordered by said plurality channels with taut straps and said drawstring to hold an accessory, wherein a plurality of segmented pockets are formed for segmenting different accessories.

3. A chair support apparatus according to claim 2 wherein said partial affixment is positioned between said first and second flexible planar panels and constructed via stitching.

* * * * *